US005775267A

United States Patent [19]

Hou et al.

[11] Patent Number: 5,775,267

[45] Date of Patent: Jul. 7, 1998

[54] INSTANT HOT WATER BOILER STRUCTURE

[76] Inventors: Liang-Yu Hou, No. 215, Shin-Chen Road Yang Mei, Tao Yuan; Kun-Huang Chuang, No. 13, Lane 15, Shin-Chung-Bai Road, Chung Li City, Tao Yung, both of Taiwan

[21] Appl. No.: 703,315

[22] Filed: Aug. 26, 1996

[51] Int. Cl.[6] ..... F22B 7/04

[52] U.S. Cl. ..... 122/13.2; 122/17; 122/33

[58] Field of Search ..... 122/13.2, 17, 32, 122/33, 35, 209.1, 218, 219, 235.31, 235.32

[56] References Cited

U.S. PATENT DOCUMENTS

| | | | |
|---|---|---|---|
| 3,826,240 | 7/1974 | Miyahara | 126/355 |
| 4,178,907 | 12/1979 | Sweat, Jr. | 122/33 |
| 5,207,211 | 5/1993 | Hanning et al. | 122/17 |
| 5,338,184 | 8/1994 | Dalhuisen | 122/17 |

*Primary Examiner*—Henry A. Bennett
*Assistant Examiner*—Gregory Wilson
*Attorney, Agent, or Firm*—Pro-Techtor International

[57] ABSTRACT

The boiler has on the top thereof, a smoke discharging cover with a water receiving tank, the interior thereof includes an upper combustion chamber and a lower water storage chamber, a water storage tank is provided between the boiler wall and the combustion chamber in which there are a burner and a heat exchanger constructed by welding bundles of pipes on the bottom of a water collecting tray, many water chambers are formed by the partitions in the water collecting tray, the pipes communicate with the water chambers, further heat absorbing passageways are formed within the boiler wall and the smoke discharging cover, these can lengthen flowing time of water and enlarge area for heat exchange, rate of heat exchange and life of use of the heat exchanger are improved, dismounting of the heat exchanger for cleansing is also feasible.

5 Claims, 5 Drawing Sheets

INSTANT HOT WATER BOILER STRUCTURE

BACKGROUND OF THE INVENTION

1. Field of the Invention

The present invention is related to an instant hot water boiler structure having on its top end a smoke discharging cover with a water receiving tank, wherein, it is designed so that the interior of the body of the boiler is divided into an upper combustion chamber and a lower water storage chamber; the hot water instant boiler structure provided by the present invention is especially related to a boiler type heat exchanger specifically for heating water flow, the heat exchanger of the combustion chamber in the boiler can have more heating area within the given space of chambers and tanks, by providing heat absorbing passageways within the wall of the boiler and the smoke discharging cover, rate of heat exchange of the boiler can be adequately increased, and life of use of the heat exchanger in the hot water boiler can thereby be lengthened, besides, dismounting of the heat exchanger for cleansing is feasible.

2. Description of the Prior Art

Conventional hot water boilers sold in the markets provide heat by using a heating source to heat water flow of lower temperature for supplying high temperature water flow, this takes advantage of heat exchange between gas of higher temperature and fluid of lower temperature; however, heating sources used in hot water boilers, taking the advanced ones in the markets as examples, have been improved against the conventional ways of burning coal or wood to generate fire for heating, and now fuel or gas is burned to sufficiently mix in a given ratio with air forcedly conveyed for spurt igniting to form strong and huge fire flame for heating, efficiency of heat energy generating thereof is extremely high; such kind of heater for generating high temperature requires an equipment for sufficiently absorbing heat to proceed heat exchanging rightaway, heating efficiency for water flow in such a hot water boiler thus can be increased, this equipment is so called heat exchanger; in order to increase heating exchanging efficiency of the heat exchanger, the key matter is that whether heat exchanging area can be effectively increased to render water flow to be retained within the wall of the heat exchanger for a longer time, so that water flow can absorb much more heat energy by transmission of the wall of the heat exchanger, and thereby heating efficiency of water flow can be increased. Taking the technique known to the public of the advanced heat exchangers of hot water boilers in the markets as examples, allocation of members therein is not ideal, they have the following disadvantage:

1. Heat exchangers of hot water boilers formed by the serpentine heating pipes and the undulated wall of the boilers can lower inflation and deflation in pursuance of hot and cool state as is the conception originally contemplated, and can slightly increase area for accepting heat by water flow to increase absorption capability of heat energy, however, processing for serpentine heating pipes and the undulated wall of the boilers is hard, cost of manufacturing thereof hence is much higher, this is practically deficient as a result.

2. The bodies of the boilers formed as conical housings and the conical upper covers with annular smoke discharging channels provided on the tops of the boilers can have the function of slightly preventing emission of heat, however, the annular smoke discharging channels are of open style, rising heat in the boilers is emitted from the annular smoke discharging channels and can not be retained effectively, so that heat in the boilers will in no way approximate to saturate state, thus heat medium is seriously wasted.

3. An inner barrel is provided as a heat exchanging chamber in the body of each boiler, a plurality of water pipes welded to a plurality of cylindrical heat exchangers made with undulated plates for hot water boilers are provided in the heat exchanging chamber; slightly larger area for heat exchange is provided thereby between the barrel wall of the heat exchanging chamber and the undulated heat exchanging plates, however, the pipes and the undulated heat exchanging plates in the heat exchanging chamber are fixedly welded together to thereby form a lot of welding marks which are located at a lower bottom zone and very near to the fire source formed by flame spurted from the burner, so that the welding areas are subjected to direct burning by the fire source and very easy to be destroyed, life of use thereof will be reduced, besides, at the welding joints between the water pipes and the heat exchanging plates, a plurality of dead corners are formed by folding of the water pipes, therefore, serious impediment and overly large pressure will be created during passing of water flow, bursting may occur after being long used, the dead corners are subjected to jamming of dregs and filth, so that such kind of hot water boiler does not have the so called effect of increasing efficiency of heat exchange by improving water flow disturbance, but contrarily, serious impediment and overly large pressure are created during passing of water flow within the water pipes.

4. Such heat exchangers can not be dismounted, thereby ashes filth in the boilers produced by burning can not be cleared, and thus impedes heat conducting efficiency of the walls of heat exchangers.

5. The route of water flow in the water pipes for heat absorbing and heat exchanging provided in and around the boilers can hardly be improved any more, i.e., by given chambers and tanks for heat exchanging in the boilers, number of the water pipes for heat exchanging can not be increased, so that area for accepting heat by water flow is limited, heat conducting efficiency thereof hence is lowered.

SUMMARY OF THE INVENTION

In view of the above stated disadvantage of the conventional equipping technique of hot water boilers which result short life of use and non effective improving of heat efficiency, the inventor of the present invention continuously studies and improves based on his professional experience of years in manufacturing and selling practice to eliminate disadvantages resided in the prior arts which troubles the inventor for long, and provides the novel structure of hot water boiler of the present invention. Therefore:

The principal object of the present invention is to provide an instant hot water boiler structure wherein space is sufficiently used to get large and multilayer area for heat exchange, extreme smooth paths for water flow are formed therein, yet heat in the boiler is nearly a saturate state, this can increase heat exchanging efficiency of water to be heated, an instant heating effect thus can be achieved.

Another object of the present invention is to provide a structural design by which the heat exchanger in a hot water boiler can be dismounted in due time for cleansing the inner wall of the combustion chamber in the boiler and the oxygenized ashes filth produced by burning and accumulated on the pipe walls of the heat exchanger, so that interiors of the boiler and the heat exchanger can be kept clean for good, hence heat exchanging efficiency on the pipe walls of the heat exchanger can be increased.

According to the objects stated above, the present invention has the following advantage:

1. A water storage tank is provided encircling the combustion chamber, cool water to be heated is continuously pressed and put into the water storage tank, when water level in the tank rises up gradually to the top of the wall of the combustion chamber, water absorbs heat energy transmitted through the wall, this forms the first stage water flow warming zone.

2. A smoke discharging cover with a water receiving tank is provided, the water heated in the water storage tank as stated above in the first water flow warming stage is then guided to flow into a water receiving tank to accept heat energy rising gradually in the boiler for being discharged, this forms a middle stage water flow warming zone.

3. By welding a plurality of vertically arranged bundles of pipes on the bottom of a horizontally disposed water collecting tray in the heat exchanger, water heated in the middle stage water flow warming zone is led into the heat exchanger and circulated in every water chamber in the water collecting tray as well as the bundles of pipes, the extreme large heat exchanging area provided thereby and the advantage of sufficient prolonged water flowing time allow forming of the last stage water rapid heating zone.

4. A plurality of lug seats are provided on the wall of the combustion chamber, and correspondingly, a plurality of lugs are provided on the periphery of the water collecting tray of the heat exchanger, the lugs are placed in the lug seats, and the heat exchanger can be dismounted from the combustion chamber, therefore, the oxygenized ashes filth produced by burning and accumulated on the walls of the heat exchanger and the combustion chamber can be cleansed when is required.

5. A plurality of water chambers are formed by a plurality of partitions in the water collecting tray of the heat exchanger, hence the bundles of pipes welded to the bottom of the water collecting tray can be divided into two groups in equal number to connect with various water chambers, so that water feeding holes and water draining holes of equal number are connected with the various water chambers, and therefore water flow can proceed from/to the vertically mounted bundles of pipes for feeding/draining and can flow through all the horizontally arranged water chambers in the water collecting tray, thus a three dimentional water flow path is formed in the heat exchanger, this can provide effect of lengthening flowing time of water flow when it is flowing into the heat exchanger.

6. A plurality of U shaped pipe members are arranged to form cross typed bundles of pipes, the bend of each U shaped pipe member has the same curvature, so that value of impediment in water flow by each U shaped pipe member is the same and thus is stable, yet the bends of all the pipes have the same diameter, therefore, water path can be very smooth, this can further reduce impediment and pressure in water flow to prevent the heat exchanger from jamming.

7. Both ends of each U shaped pipe member in each bundle of pipes are welded to the bottom of the water collecting tray to form welding marks, in the combustion chamber, the welding marks are far from the fire source formed by flame spurting of the burner, so that they are not subjected to direct burning by the fire source, life of use thereof is lengthened.

8. One or more layers of separating plates in half round shape are alternately arranged and provided on the bundles of pipes to render the combustion chamber to form passageways for guiding heat gas and retard speed of rising of the heat gas during heat convection, thereby heat conducting as well as exchanging efficiency between the heat gas and water flow in the pipe walls of the bundles of pipes can be increased.

9. A chimney with a movable lid is provided on the smoke discharging port of a smoke discharging cover, unsaturated heat energy in the combustion chamber of the boiler can be kept therein by the movable lid, while contrarily, heat energy in saturated state can push the movable lid to discharge waste burned gas, in this way, waste of heating medium can be prevented.

10. A water storage chamber is provided at the bottom of the boiler for storing hot water from the heat exchanger after the last water rapid heating stage, temperature of the hot water can thereby be kept stable, in this way, weight pertaining to gravity of the lower boiler body can be increased, and the hot water can be supplied for the discharging pipe on the bottom of the water storage chamber.

The present invention will be apparent in its objects stated above as well as characteristics after reading the detailed description of the preferred embodiments thereof in reference to the accompanying drawings.

DETAILED DESCRIPTION OF THE PREFERRED EMBODIMENT

Figure 1:
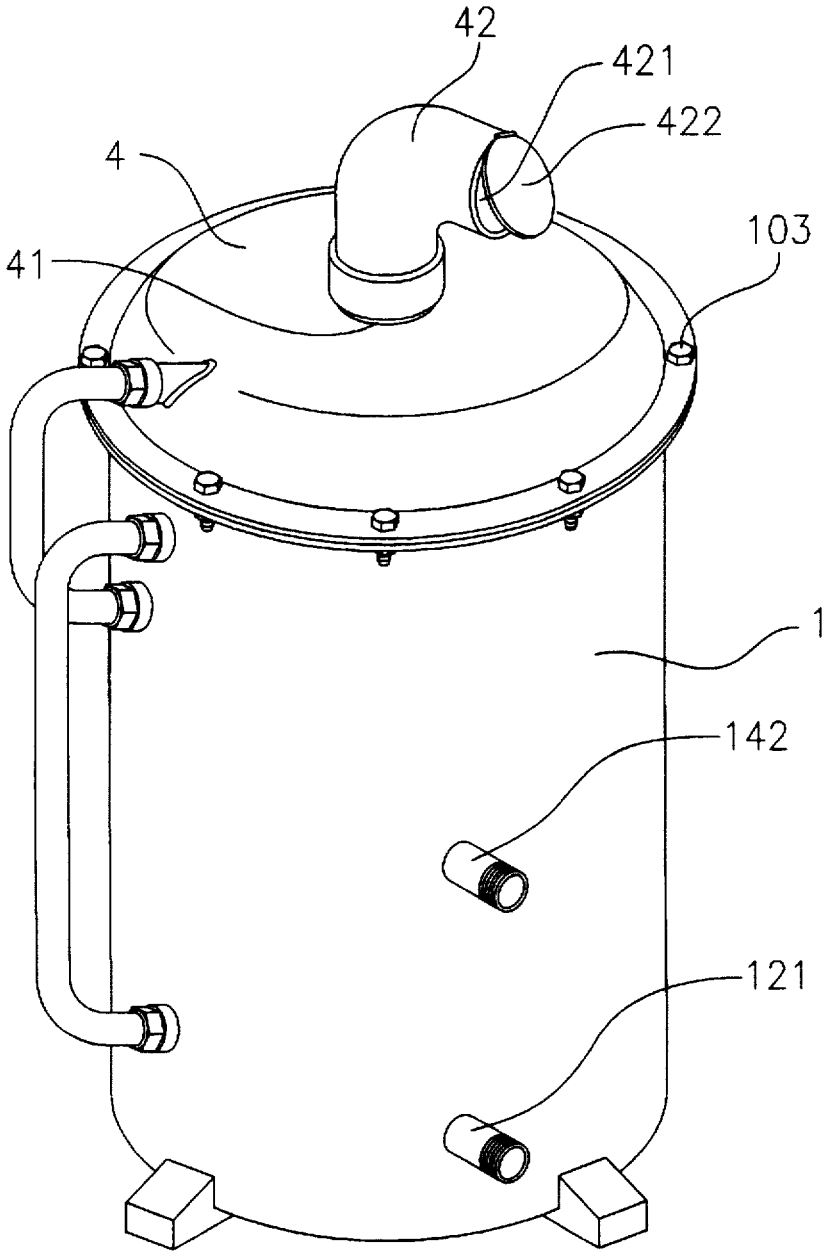
FIG. 1 is an apparent perspective view of the present invention.
Figure 2:
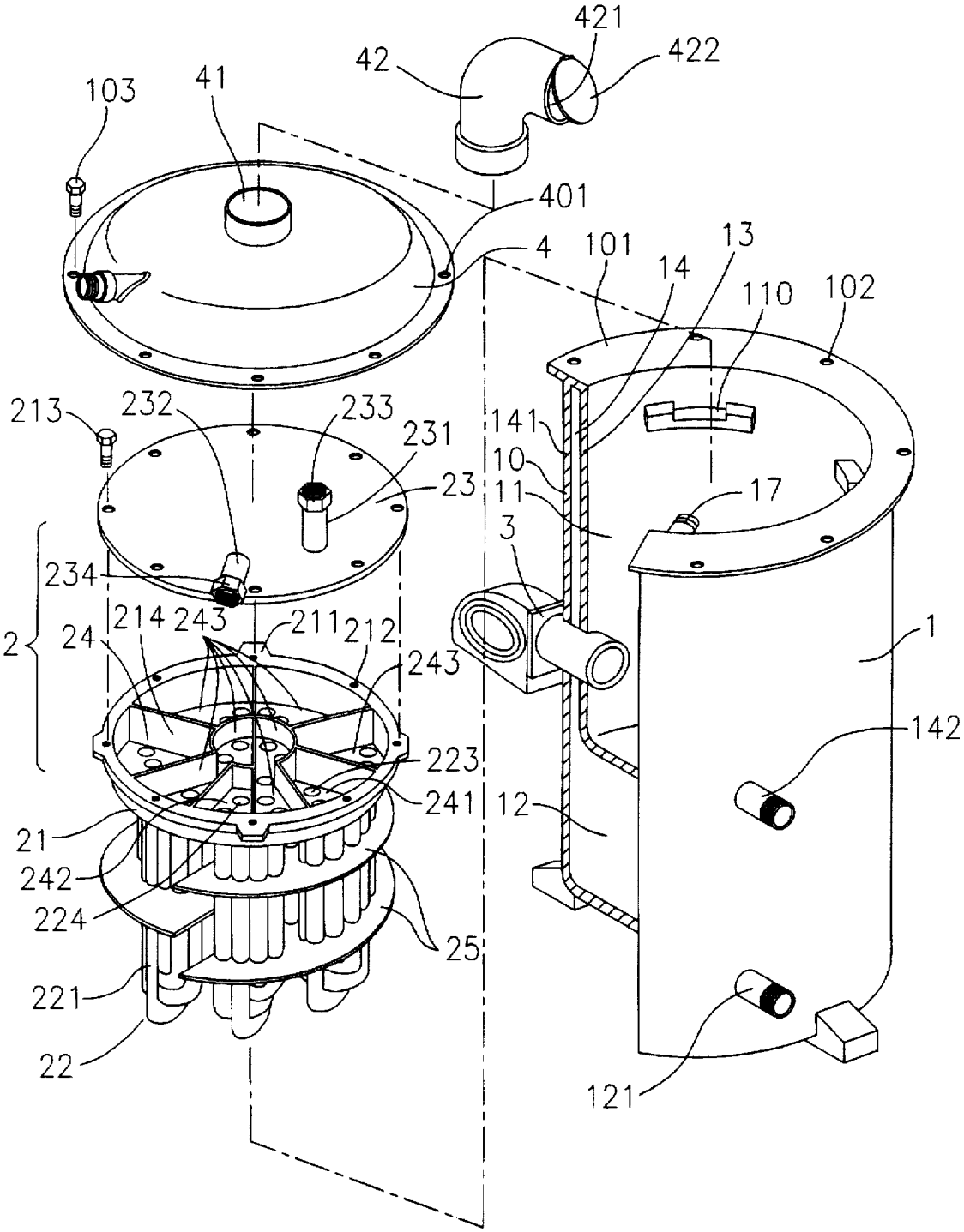
FIG. 2 is an anatomic perspective view of the present invention.
Figure 3:
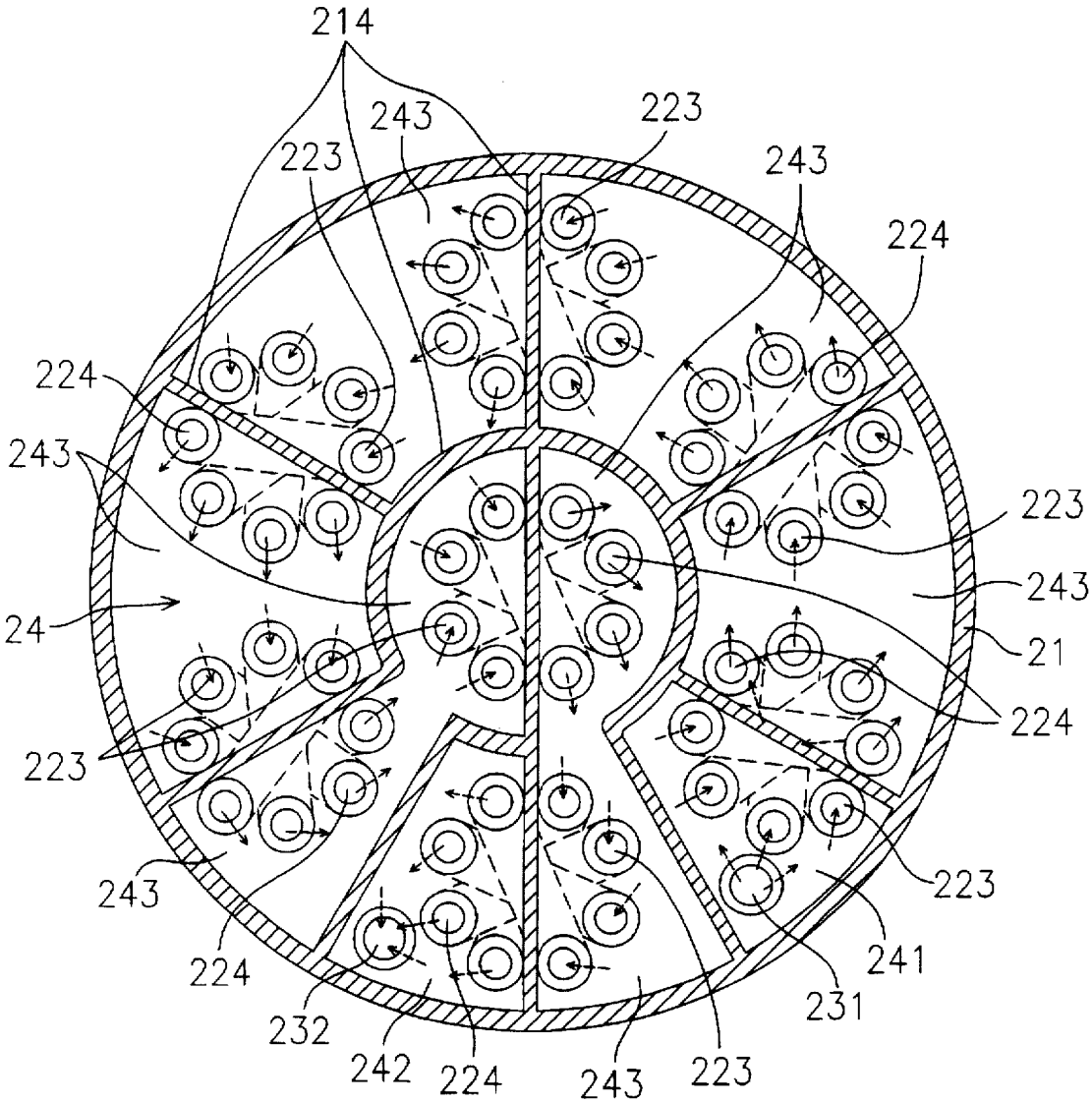
FIG. 3 is a top sectional view of the heat exchanger of the present invention.
Figure 4:
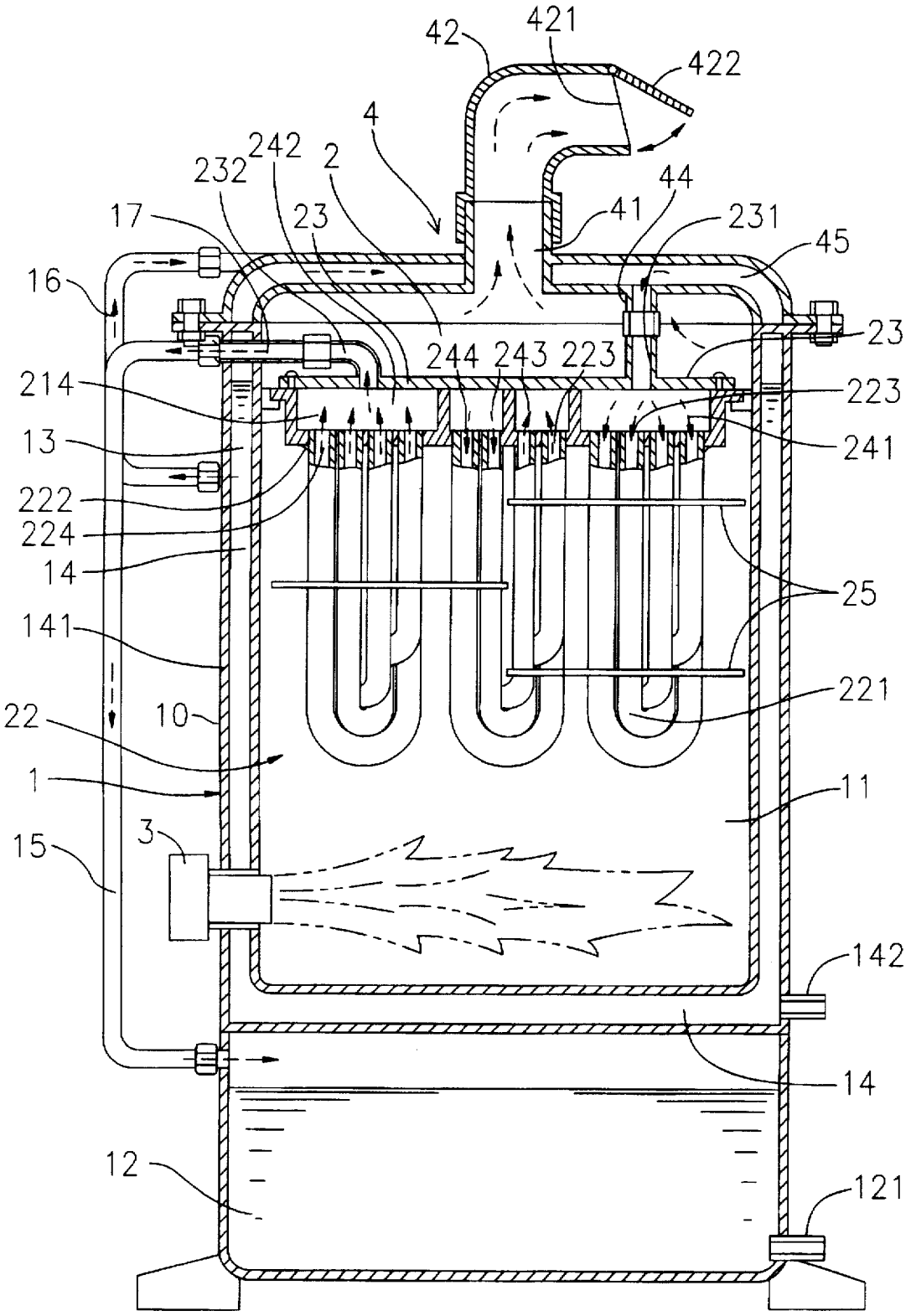
FIG. 4 is a schematic lateral sectional view of the present invention after assembling.

Referring firstly to FIG. 1 and 2, the hot water instant boiler structure the present invention is comprised mainly of a cylindrical boiler body 1, the interior of the boiler body 1 is divided into an upper combustion chamber 11 and a lower water storage chamber 12, the upper section of the upper combustion chamber 11 is provided with a heat exchanger 2 therein, while the lower section thereof is provided with a burner 3, and finally, a smoke discharging cover 4 is locked on the top of the boiler. Wherein, as shown in FIG. 2, 3 and 4:

The combustion chamber 11 is provided on its wall with a plurality of lug seats 110 for positioning of the heat exchanger 2, a water storage tank 14 is provided between the housing 13 of the combustion chamber 11 and the wall 10 of the boiler body 1, the wall 141 of the water storage tank 14 is enveloped with heat preservating material and therefore forms the external wall surface 10 of the boiler body 1;

A cool water inlet 142 is provided on the bottom end of the water storage tank 14, while a connecting pipe 16 is provided near the top of the water storage tank 14 and connects a water receiving tank 45 in the smoke discharging cover 4, the water storage tank 14 is communicated with the water receiving tank 45, so that cool water being pressed continuously and put into the water storage tank 14 from the cool water inlet 142 can be led into the water receiving tank 45 of the smoke discharging cover 4.

The burner 3 is provided near the bottom in the lower section of the combustion chamber 11 and is mounted from outside to give spurting flame into the combustion chamber 11 to be the heating medium in the boiler.

A hot water discharging pipe 121 is provided at the bottom of the water storage chamber 12 and protruding outwardly, so that hot water completely heated in the boiler can be discharged.

The top of the boiler body 1 is opened, an annular top flange 101 is provided on the top periphery thereof, a plurality of screw holes 102 for locking the smoke discharging cover 4 in position with a plurality of bolts 103, a plurality of holes 401 are provided around the periphery of the smoke discharging cover 4 for piercing of the bolts 103 to lock the smoke discharging cover 4 on the open top end of the boiler body 1; a central smoke discharging port 41 is provided on the smoke discharging cover 4, an L shaped chimney 42 is fitted over the smoke discharging port 41, a bevelled surface on the port 421 of the chimney 42 is provided with a movable lid 422 to control discharging/retaining of the hot gas in the combustion chamber 11.

The water receiving tank 45 is provided in the smoke discharging cover 4 around the central smoke discharging port 41, the connecting pipe 16 connects the lateral wall of the water receiving tank 45, thereby heated water in the water storage tank 14 from the first water flow warming stage can be led via the connecting pipe 16 into the water receiving tank 45 to be stored temporarily.

A water discharging pipe 44 is provided on the bottom of the other side relative to that of the connecting pipe 16 of the water receiving tank 45, water flow after the middle warming stage in the water receiving tank 45 is led into the heat exchanger 2 via the water discharging pipe 44.

The heat exchanger 2 is constructed with a plurality of vertically arranged bundles of pipes 22 on the bottom of a horizontally disposed water collecting tray 21, wherein:

The water collecting tray 21 is provided on the top periphery thereof with a plurality of lugs 211 for engaging in the corresponding lug seats 110 of the combustion chamber 11, so that the heat exchanger 2 can be dismounted from the combustion chamber for cleansing oxygenized ashes filth produced by burning and accumulated on the wall of the heat exchanger 2 and the combustion chamber 11, a plurality of screw holes 212 are provided on the top of the water collecting tray 21 for locking a disk like cover 23 together with a plurality of screws 213, the disk like cover 23 is provided at suitable locations thereof with a water injection pipe 231 and a water releasing pipe 232 respectively, the ends of these pipes 231, 232 are provided with nuts 233, 234 for connecting.

Referring to FIG. 3, a plurality of partitions 214 arranged in radiate mode are provided in the water collecting tray 21 to form a plurality of encircling water chambers 24 which are assigned as a water feeding chamber 241, a water discharging chamber 242 and a plurality of water exchanging chambers 243 which are located between the water feeding chamber 241 and the water discharging chamber 242 in both clockwise and counterclockwise directions; wherein the water injection pipe 231 is connected to the water discharging pipe 44 of the smoke discharging cover 4 by the nut 233, the water injection pipe 231 is further connected to the water feeding chamber 241 for supplying water flow led from the water receiving tank 45 of the smoke discharging cover 4.

The water releasing pipe 232 is connected to a water guiding pipe 17 by the nut 234 and is extended through and out of the wall 10 of the boiler body 1, and then is connected with a water draining pipe 15 to communicate with the water storage chamber 12, so that water flow in the heat exchanger 2 can flow through the water discharging chamber 242, the water releasing pipe 232, the water guiding pipe 17 and the water draining pipe 15 and into the water storage chamber 12 at the bottom of the boiler body 1.

Numerous U shaped pipe members 221 are arranged to be encircled one by another to form a plurality of cross typed bundles of pipes 22 (also referring to FIG. 2), each bundle of pipes 22 is welded to the bottom of the water collecting tray 21, so that each end of the U shaped pipe members 221 of each bundle of pipes 22 is formed a welding mark 222 (as shown in FIG. 4) which is far from the fire source.

The U shaped pipe members 221 of each bundle of pipes 22 are divided into two groups in equal number to connect with various water chambers 24, so that the water feeding chamber 241 is provided with a plurality of water feeding holes 224 connected to a plurality of U shaped pipe members 221, while the water discharging chamber 242 is provided with the same amount of water draining holes 223 connected to some other U shaped pipe members 221; moreover, the water exchanging chambers 243 each is provided with the same amount of water feeding holes 224 and water draining holes 223, so that water flow in the water feeding chamber 241 can be supplied sequentially for the water exchanging chambers 243 and for the water discharging chamber 242 to be discharged, water flow thereby can proceed in turn from the vertical feeding/draining direction in the bundles of pipes 22 to the horizontal direction in various water chamber 24 of the water collecting tray 21, thus a three dimentional water flow path is formed in the heat exchanger 2.

One or more layers of separating plates 25 in half round shape are alternately arranged and provided on the bundles of pipes 22 to render the combustion chamber 11 to form passageways for guiding heat gas and retard speed of rising of the heat gas from the burner 3 in the lower section of the combustion chamber 11 led by the separating plates 25 during heat convection, thereby heat conducting as well as exchanging efficiency between the heat gas and water flow in the pipe walls of the bundles of pipes 22 can be increased.

As shown in FIG. 4, when feeding water to activate the burner 3 to spurt flame, cool water is fed to the cool water inlet 142 to be injected into the water storage tank 14 by means of the supply line of tap water, cool water in the water storage tank 14 rises gradually to cover the whole inner wall of the housing 13 of the combustion chamber 11, the spurted flame generated in the combustion chamber 11 by the burner 3 has already produced heat gas to transmitted via the housing 13, in this way, cool water in the water storage tank 14 accepts heat conduction from the housing 13 immediately and to be heated to form the first water flow warming stage. Water flow after treating of the first water flow warming stage is raised and flow into the water receiving tank 45 of the smoke discharging cover 4, now if temperature of the hot gas heated by spurted flame in the combustion chamber 11 has not yet approached saturated state, the movable lid 422 on the chimney 42 is closed, when temperature of the hot gas in the combustion chamber 11 is nearly saturated and produce pushing force by the hot gas, the lid 422 will be opened and discharge surplus waste gas, meantime, water flow in the smoke discharging cover 4 continuously absorbs heat in the rising hot gas to be discharged in the combustion chamber 11 to form the middle water flow warming stage. Water flow after treating of the middle water flow warming stage is led to the water feeding chamber 241 of the heat exchanger 2 via the water discharging pipe 44 and the water injection pipe 231, and then is discharged to the U shaped pipe members 221 of each bundle of pipes 22 through the equally numbered water draining holes 223 on the bottom of the water feeding chamber 241, now the water flow is given heating action by conduction of the wall of the combustion chamber 11, and is communicated with the bundles of pipes 22 between the water feeding holes 224 and water draining holes 223 on all the bottoms of the water changing chambers 243, so that water flow can gradually accept heat conducting in the three dimentional flow path in the vertical U shaped pipe members 221 and the horizontal water chambers 24 to form the last water rapid heating stage. Water flow in treating of the last water flow heating stage and having absorbed heat energy in the heat exchanger 2 is guided by the water releasing pipe 232 in the water discharging chamber 242 and the water guiding pipe 17 and the water draining pipe 15 to discharge into the water storage chamber 12 at the bottom of the boiler body 1 for storing, at this time, temperature of water can be kept stable by such storage, hot water is to be supplied when is required, water can be automatically supplied by water pressure created by gravity thereof from the hot water discharging pipe 121 provided at the bottom of the water storage chamber 12. Cycling operation of water feeding and heating in the hot water instant boiler of the present invention is thus established.

Figure 5:
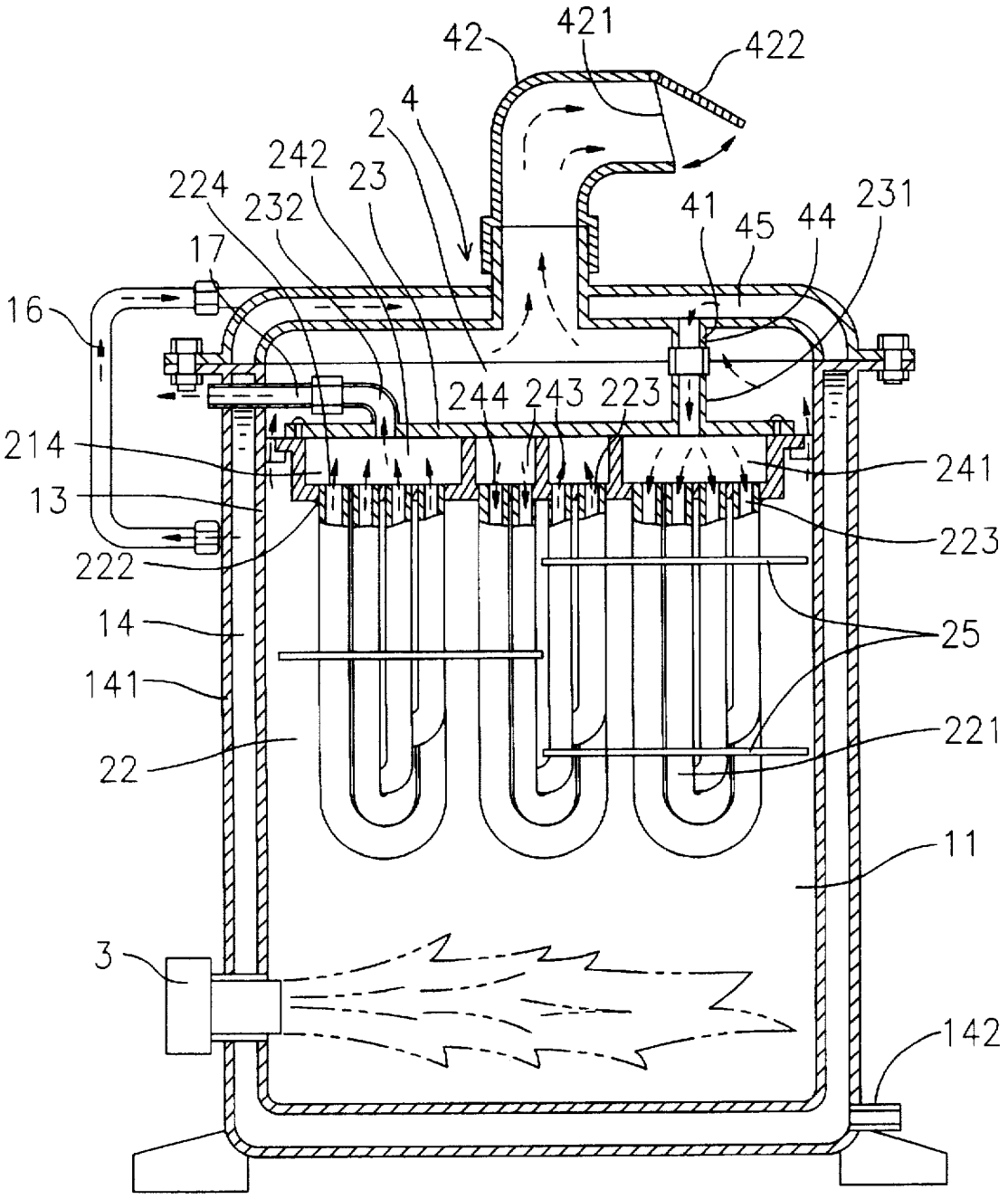
FIG. 5 is a sectional view of another embodiment of the present invention.

In another embodiment of the present invention, as shown in FIG. 5, the water storage chamber 12 at the bottom of the boiler body 1 and the water draining pipe 15 connecting with the water guiding pipe 17 are omitted, while the water guiding pipe 17 is exposed directly for supplying hot water, in this case, a spot where there is no equipment of water storing device can have such a boiler omitting the above mentioned members to lower cost of equipment, this is also a preferred embodiment of the present invention.

The outside surface of the above mentioned wall 10 of the boiler body 1 is exposed directly and thus is subjected to being touched, it is therefore enveloped with a coat of temperature preservating and heat insulating material to preserve temperature as well as to protect people from being damaged.

While preferred embodiments of the present invention have been known and described hereinabove, it is apparent that various changes and modifications might be made without departing from the scope of the invention which is set forth in the accompanying claims.

We claim:

1. An instant hot water boiler structure, comprises:

a water storage tank provided between a combustion chamber and the wall of said boiler, these members being the first stage water flow warming chamber and tank;

a smoke discharging cover with a water receiving tank provided and locked on the top end of said boiler, said water receiving tank being the middle stage water flow warming tank;

a heat exchanger is removably hung in said combustion chamber to be the last stage water flow rapid heating chamber;

numerous pipes being provided to communicate with all said chamber and tanks sequentially, said boiler structure is characterized in that:

said heat exchanger is constructed with a plurality of vertically arranged bundles of pipes welded to the bottom of a horizontally disposed water collecting tray, wherein;

said water collecting tray is provided with a disk like cover which is provided at suitable locations thereof with a water injection pipe and a water releasing pipe respectively;

a plurality of partitions are provided in said water collecting tray to form a plurality of encircling water chambers which are assigned as a water feeding chamber, a water discharging chamber and a plurality of water exchanging chambers which are located between said water feeding chamber and said water discharging chamber in both clockwise and counterclockwise directions;

each of said bundles of pipes is welded to the bottom of corresponding and neighbouring water chambers of said water collecting tray, numerous U-shaped pipe members are arranged to be encircled one by another to form said bundles of pipes in cross type, each said U shaped pipe member of said bundles of pipes has the same curvature and same diameters, the ends of said U-shaped pipe members are divided equally into two groups to connect with corresponding water chambers, so that said water chambers are provided on the bottom thereof with a plurality of water feeding holes and water draining holes for communication, water flow thereby can flow through said water feeding chamber, water discharging chamber and water exchanging chambers in a three dimentional flow path.

2. An instant hot water boiler structure as claimed in claim 1, wherein, said water collecting tray is provided on the top periphery thereof with a plurality of lugs for engaging in a plurality of corresponding lug seats on the wall of said combustion chamber, so that said heat exchanger can be mounted in said combustion chamber.

3. An instant hot water boiler structure as claimed in claim 1, wherein, One or more layers of separating plates in half round shape are alternately arranged and provided on said bundles of pipes to render said combustion chamber to form passageways for guiding heat gas.

4. An instant hot water boiler structure as claimed in claim 1, wherein, a lower water storage tank is provided separately at the bottom of said combustion chamber of said boiler, said water storage tank is communicated with a water draining pipe led from said heat exchanger, hot water can thereby stored therein, and center of gravity of the lower portion of said boiler can be stable.

5. An instant hot water boiler structure as claimed in claim 1, wherein, said partitions in said water collecting tray preferably are arranged in radiate mode in said round water collecting tray.

* * * * *